US011746448B2

(12) United States Patent
Zheng et al.

(10) Patent No.: US 11,746,448 B2
(45) Date of Patent: Sep. 5, 2023

(54) FLAME RETARDANT VISCOSE FIBER

(71) Applicant: HANGZHOU ANCHUANG TEXTILE CO., LTD., Hangzhou (CN)

(72) Inventors: Pan-Xiang Zheng, Hangzhou (CN); Wei-Cai Guo, Gaomi (CN); Na Hu, Gaomi (CN)

(73) Assignee: HANGZHOU ANCHUANG TEXTILE CO., LTD., Hangzhou (CN)

( * ) Notice: Subject to any disclaimer, the term of this patent is extended or adjusted under 35 U.S.C. 154(b) by 126 days.

(21) Appl. No.: 17/233,313

(22) Filed: Apr. 16, 2021

(65) Prior Publication Data

US 2022/0228301 A1 Jul. 21, 2022

(30) Foreign Application Priority Data

Jan. 21, 2021 (CN) ..... 202110083914.9

(51) Int. Cl.

| | |
|---|---|
| ***D03D 15/513*** | (2021.01) |
| ***D01G 13/00*** | (2006.01) |
| ***D06M 11/79*** | (2006.01) |

(52) U.S. Cl.

CPC ..... *D03D 15/513* (2021.01); *D01G 13/00* (2013.01); *D06M 11/79* (2013.01); *D06M 2200/30* (2013.01); *D10B 2201/24* (2013.01)

(58) Field of Classification Search

CPC .. D10B 2201/24; D03D 15/513; D01G 13/00; D06M 11/79; D06M 2200/30; D01F 1/07; D01F 2/10; D01F 2/08; D02G 3/443; D04B 1/14

USPC ..... 428/920, 921

See application file for complete search history.

(56) References Cited

U.S. PATENT DOCUMENTS

2010/0019213 A1* 1/2010 Tian ..... D01F 1/07 252/608

* cited by examiner

*Primary Examiner* — Elizabeth M Imani

(74) *Attorney, Agent, or Firm* — Cheng-Ju Chiang

(57) ABSTRACT

A flame retardant fabric is directly woven from flame retardant viscose fiber added with inorganic silicon for covering the outside of flammable articles, wherein the flame retardant viscose fiber having denier, strength and flame retardant effect which use silicic acid as the flame retardant, and coating a layer of organic material, melamine flame retardant resin on the surface of silicic acid, and then preparing the flame retardant viscose fiber into an nano-sized particles. The flame retardant fabric has a fineness of 1.11 to 2.78 dtex, and a strength of ≥2.0 cN/dtex, which meets the production requirements of spinning, and does not need to be blended with other high-strength fibers when spinning, and the woven fabric from the flame retardant viscose fiber does not need to be flame retardant, so that the flame retardant fabric has a good flame retardant effect and saves costs through simply the production process.

3 Claims, No Drawings

FLAME RETARDANT VISCOSE FIBER

BACKGROUND OF THE INVENTION

1. Field of the Invention

The present invention generally relates to a technical field of the textile, and more particularly to a flame retardant fabric.

2. Related Art

The combustion performance of indoor textiles and upholstered furniture has an important impact on the occurrence and spread of fires. In order to ensure the safety of personal and property, developed countries and regions such as the United States, the European Union, and Canada began to supervise and continuous improvement them in the form of legislation since 1950. For example, the US CPSC has formulated two standards for the combustion performance of mattresses, which are Standard for the Flammability of Mattresses and Mattress Pads and Open Flame Standard for Mattress Sets, 16 CFR 1632 and 16 CFR 1633, the both standards set different requirements for mattresses, and mattresses sold in the US market must meet the requirements of these two standards at the same time.

In indoor textiles and upholstered furniture, such as the mattress cloth is filled with flammable materials such as sponge or latex. Therefore, not only does the mattress cloth need to be flame retardant, but the mattress cloth also need to won't ruptured after fire disaster, so as to prevent the open flame from spreading to the flammable material and cause a big fire. Moreover, flame retardant fabrics added with organic flame retardants, such as organic phosphorus or halogen flame retardants, although the flame retardant fabric is not easy to catch fire, but it is easy to be ruptured after encountering a fire disaster, so that the flame will contact the flammable filling inside the flame retardant fabric, causing the filling catch fire, and expand the rupture in the flame retardant fabric, and let the air more circulated, which will cause a big fire. Therefore, flame retardant fabrics used to cover flammable materials not only need to be flame retardant, but also must not rupture when exposed to fire. In other words, the flame retardant fabric must still completely cover the outside of the flammable filling after burning.

In the flame retardant viscose fiber containing silicic acid, the silicic acid is further polymerized into polysilicic acid in the viscose fiber collagen solution, which formed the network-shaped polysilicic acid/polysilicate molecules and combined with the large amount of chemically bound water to have relatively high properties including high temperature resistance and flame retardant effect. Silicic acid after combustion is decomposed into silicon dioxide. Silica has high temperature resistance. The remaining components in the flame retardant adhesive generate dense residual carbon, which covers the surface of flammable materials. It is beneficial to isolate the combustion surface from contact with oxygen and heat exchange. Not only is the fabric not easy to burn, but also generates dense residual carbon after burning to prevent the open flame from spreading to the combustibles in the inner layer.

On the other hand, flame retardants containing phosphorus or halogen have a certain degree of toxicity during the combustion process, and there is also a problem of environmental pollution. The silicon flame retardant has the characteristics of high efficiency, non-toxicity, low smoke, anti-dripping, and no pollution. At the same time, it does not produce toxic gas when burned, and only produces a small amount of smoke and $CO_2$ gas. Compared with other flame retardant fibers, it has low cost, no pollution, and can be naturally biodegraded into organic and inorganic small molecules mixed in the soil, which is very suitable for flame retardant mattress fabric fibers.

In the existing flame retardant viscose fiber containing silicic acid, which have an uneven distribution of inorganic nanoparticles. The inorganic silicic acid or its salt is not coated in the aqueous solution, and self-polymerization is prone to occur. Silicic acid can gradually change from monosilicic acid by polymerizes into polysilicic acid, and finally becomes a silicic acid gel, causing problems such as accelerated aging of the viscose fiber collagen solution, a sharp increase in viscosity and failure to spin. In addition, when a qualified flame retardant effect is required that the fineness of the fiber is basically above 3.0, it is difficult to directly use the flame retardant viscose fiber in spinning due to the fact that the strength of the fiber is reduced. Generally, it needs to be mixed with other high-strength fibers or use viscose fiber for spinning, and finish the flame retardant yarn or fabric to achieve the flame retardant effect. Since the fiber is woven into a fabric and then soaked in a liquid containing a flame retardant, the fabric has a good flame retardant effect in the initial stage, but it is not washable. With the passage of time and the increase in washing times, the flame retardant effect will gradually decline and even disappear.

In view of the above problems, it is practical to develop a flame retardant fabrics with denier, strength and flame-retardant properties.

SUMMARY OF THE INVENTION

An object of the present invention is to provide a flame retardant fabric for covering the outside of combustible items, such as mattresses, sofa cushions, etc., the flame retardant fabric is directly woven from flame retardant viscose fiber added with inorganic silicon which is a flame retardant viscose fiber. The flame retardant fabric has a fineness, strength and flame retardant effect which meet the requirements of existing standards for flame retardant fabrics. The woven fabric from the flame retardant viscose fiber does not need to be blended with other high-strength fibers when spinning, so that the flame retardant fabric has a good flame retardant effect and saves costs through simply the production process.

To achieve the above object, the flame retardant fabric in accordance with the present invention is woven by spinning flame retardant viscose fiber, an inorganic flame retardant component in the flame retardant viscose fiber is a silicic acid, the fineness of the flame retardant viscose fiber is 1.11~2.78 dtex, the dry strength of the flame retardant viscose fiber is greater than 2 cN/dtex, and the dry elongation of the flame retardant viscose fiber is 13~20%.

Further, the limiting oxygen index value of the flame retardant fabric is not less than 32%, and the combustion residue is not less than 30%.

Further, the inorganic flame retardant component is a silicic acid substance, the silicic acid substance is coated with an organic material which is melamine flame retardant resin on the surface of silicic acid substance, to form flame retardant particles.

Further, the silicic acid is obtained by acidification of sodium silicate, the melamine flame retardant resin is prepared from melamine, carbonamide and formaldehyde, and the added quantity of the melamine is 15-20% of the sodium silicate, the added quantity of the carbonamide is 1-5% of the sodium silicate, and the added quality quantity of the formaldehyde is 20-40% of the sodium silicate.

Further, the effective component of the silicic acid is silica, the added quantity of silica is 30-50% of the flame retardant viscose fiber.

Further, the preparation method of the flame retardant particles is as follows:

Dissolving $Na_2O \cdot nSiO_2$ (wherein n=1~1.5) in pure water at a temperature of 50~80° C. and stirring evenly for 30 minutes, then slowly add dilute sulfuric acid solution dropwise; adjusting the pH to 3~4 to obtain a silicic acid solution; and according to the quality of $Na_2O \cdot nSiO_2$, using 15~20% melamine, 1~5% carbonamide, 20~40% formaldehyde, then add 1.5~3.0% dispersant, adjusting the pH to 9 with triethanolamine at under 70~80° C. through high-speed shearing and stirring with stirring speed 7000~8000 r/min, to obtain the prepolymer mixture. The prepolymer mixture is put into the silicic acid solution by dripping under high-speed stirring and filtered to prepare a uniformly dispersed flame retardant slurry.

Further, the dispersant is styrene-maleic anhydride.

Further, the flame retardant particles have a particle size ≤1 particle.

DESCRIPTION OF THE INVENTION

The embodiments of the present invention are described below for the invention easier to be understood. However, the present invention should not be construed as being limited to the methods, conditions or references in the embodiments set forth herein. In contrast, the terms are provided in embodiments so that the scope of the invention will be fully understood by those skilled in the art and should not limit the scope of the invention.

The specific process of the present invention is as follows:

1. Preparing Flame Retardant Viscose Fiber (1) Preparing Spinning Stock Solution Soaking the pulp raw material in a sodium hydroxide solution with a temperature of 53° C. and a concentration of 17% to 18%. After 45 minutes, the Alkaline liquid will dissolve the low-polymerization degree of hemicellulose to obtain the undissolved part, which is α-cellulose. Press to obtain alkali cellulose with a diameter of 15 μm~20 μm. The alkali cellulose is crushed and aged. The aging temperature is 20~25° C., and the aging time is 2 h; then 30~40% CS2 of α-cellulose quantity is added and mixed for yellowing reaction. The yellowing temperature is 15~20° C., and the yellowing time is 30~60 minutes to generate cellulose xanthate; dissolve the cellulose xanthate in 5% sodium hydroxide solution to obtain a spinning solution, and then add α-cellulose 2% denaturant, the spinning solution continue the process in turn by dissolved, filtered, defoamed, and matured to obtain a spinning Stock solution that can be directly spun.

During the yellowing process, carbon disulfide molecules penetrate into the cellulose through the alkali filled between the cellulose molecules, so that the alkali cellulose molecules are bound with sulfonic acid groups, which makes the distance between the cellulose molecules larger, and the structure is looser. When cellulose xanthate is dissolved in sodium hydroxide solution to prepare spinning Stock solution, the concentration of NaOH has a great impact on the solubility of sodium cellulose xanthate or the performance of viscose fiber after dissolution. Increase the concentration of NaOH to A certain range accelerates swelling and dissolution, and the viscosity of the obtained viscose fiber is also lower. The solubility of sodium flavone is the best when the NaOH concentration is 4~8%, and the viscosity stability is also high. The concentration will rise when the concentration of NaOH exceeds 8%, and the dissolving power decreases, causing the stability of the viscose fiber to decrease, and the viscosity rises.

(2) Preparing Flame Retardant Slurry

Dissolving $Na_2O \cdot nSiO_2$ (where n=1~1.5) in pure water at a temperature of 50~80° C. and stirring evenly for 30 minutes, then slowly add dilute sulfuric acid solution dropwise; adjusting the pH to 3~4 to obtain a silicic acid solution; and according to the quality of $Na_2O \cdot nSiO_2$, using 15~20% melamine, 1~5% carbonamide, 20~40% formaldehyde, then add 1.5~3.0% dispersant, adjusting the pH to 9 with triethanolamine at under 70~80° C. through high-speed shearing and stirring with stirring speed 7000~8000 r/min, to obtain the prepolymer mixture. The prepolymer mixture is put into the silicic acid solution by dripping under high-speed stirring and filtered to prepare a uniformly dispersed flame retardant slurry. In this process, sodium silicate is acidified into silicic acid, and then the silicic acid is wrapped by polymers of carbonamide, formaldehyde and melamine to form nano-scale flame retardant particles. The silicic acid particles wrapped with organic matter can be evenly dispersed in the viscose fiber, and the self-polymerization of inorganic silicic acid can prevent the viscosity from increasing sharply and making it impossible to spin.

It is significant influence on the nano-particle size of the flame retardant slurry under different stirring speeds, as is well known, the nano-scale solid particles can be obtained at a high speed, and under the higher the speed, the smaller of the average particle size can be obtained, but the change of particle size is not obvious when the rotation speed is greater than 7000 r/min.

Styrene-maleic anhydride is used as a dispersant, which can reduce the surface tension of the dispersed phase and facilitate dispersion. Thereby, the system can be stabilized and uniform fine particles can be formed. The dispersing effect is not ideal when sodium lauryl sulfate, sodium dodecylbenzene sulfonate, etc. are used as dispersants, and a large amount of silicic acid is not encapsulated by organic matter.

(3) Injecting Flame Retardant and Denaturant Before Spinning

The temperature of the spinning solution is controlled at 20~25° C. by the heat exchanger, and 30-50 wt % of the effective ingredients of the flame retardant slurry for α-cellulose is injected into the spinning solution, then pass through the first pre-spinning injection system, afterwards, the spinning solution is uniformly mixed by the static mixer, and inject the denaturant therein, then pass through the second pre-spinning injection system, so that form into a spinning stock solution, further, the spinning solution is continuation uniformly mixed by the dynamic and static mixer to obtain the spinning Stock solution that can be directly spun.

The denaturant could be adopted the following one or more ingredients which includes aliphatic amine, ethanolamine, polyoxyethylene, polyoxyalkylene glycol, polyethylene glycol, aromatic alcohol, polyol, diethylamine, dimethylamine, cyclohexylamine, alkylamine polyethylene glycol, and the preferably two or more of the above denaturants are used as mixed denaturants.

(4) In the spinning machine, the spinning Stock solution reacts with the coagulation bath while being extruded by the nozzle and to obtain the nascent fiber tow; the coagulation bath component sulfuric acid 95~120 g/L, zinc sulfate 25~55 g/L, sodium sulfate 250~300 g/L, reaction temperature: 40~50° C., and two bath temperature 90~95° C.

(5) Post-processing:

The nascent fiber tow further process by 25-40% nozzle drafting, 30-40% spinning disk drafting, 8% plasticizing bath drafting, and which use −1% re-tracting drafting to the aforesaid four drafting and plasticizing and shaping, then, cutting and post-treatment are carried out. The post-treatment processes include pickling, desulfurization, water washing, and oiling; and then drying to obtain flame retardant viscose fiber.

2. Production Process of Flame Retardant Fabric (1) Blowing process: In the opening and cleaning process, the process route of "fine grabbing, less or no falling, more combing and less beating, and full opening" is adopted. The air outlet of the dust cage adopts a full air supply method, the beater speed is 600-800 rpm; the blade extension height is 2.5~3.0 mm; the distance between the needle beater and the integrated beater is 12*20 mm; the distance between the dust rods should be 12*20 mm; the distance between dust rods should be as small as 3 mm; the dust rod in the miscellaneous area of the beater room is installed reversely to achieve the purpose of reducing or not dropping. In order to prevent the roll from being too bulky and sticky, appropriately reduce the volume of the roll weight to 350~370 g/m.

(2) Carding process: The carding process must ensure that the fiber web is clear, reduce the number of nep, and maintain the straightness and separation of the fibers in the cotton web, the cylinder speed is 300~340 r/min, moreover, the licker roll speed should be reduced to 600~750 r/min, the reason is that the licker not only the strong ability of piercing and dividing the fiber, but also avoiding the licker-in-the-roller. Further, to avoid the cylinder winding around the cotton and card clothing stuffing, the distance between the cylinder and the cover should be control 9*9*8*8*7 inches, the distance between the cylinder and the front cover can be appropriately enlarged to 30*38*38*30 inches, and the tension draft ratio should be small and controlled at 1 to 1.1 times. Also, if there is no smoothness that the fiber strip is bulky and is easy to block the bell mouth and the inclined tube of the coil, it can be adopt the following process measures including to reduce the doffer speed (13~15 r/min), to increase the pressure of the roller (16~18 kg), and to reduce the diameter of the compressed horn (2.6~3.0 mm), to sprinkle talcum powder in the ring channel, to leave sliver on the empty sliver tube before processing.

(3) Drawing process: Choosing the process principle of "heavy pressure, large gauge, strong control, and slow speed" is the most critical process for the production of flame retardant fibers. The roller gauge should be appropriately enlarged to 15 mm×25 mm during pre-binning to keep the drafting stable. At the same time, it adopts the forward drafting process configuration, and the drafting ratio is controlled at about 7.0~8.0 times. In addition, the drawing length should be appropriately reduced to 1500~2000 meters to avoid the fiber layer being too high when the capacity is large because the cotton sliver is fluffy. Further, it is easy to stick to the pile cover, wind roller, rubber roller, and block the loop channel due to the serious static electricity of the flame retardant fiber during production.

For the above reasons, the following process measures an able to avoid the blockage of the inclined tube of the coil, and ensure the smooth delivery of the strip, which is including the relative humidity of the workshop should be controlled at 70-75%, and the top roller should be an anti-static top roller, and reduce the speed of the front roller, and wipe the bell mouth and the inclined tube with alcohol and sprinkle talcum powder; keep the channel smooth and smooth to reduce friction resistance; choose a smaller diameter of the bell mouth (2.6, 2.8); increase the pressure of the pressing roller (13.5-14.5 kg), etc.

(4) Roving process: The roving process adopts the process configuration as follows "medium basis weight, heavy pressure, strong control, low speed, large roller gauge and high twist", for help stabilize the relationship between the drafting force and the holding force, and prevent "hard ends", the following step should done including with the basis weight control at 3.0~4.5 g/10 m, and the speed reduction at 500-600 r/min, the roller gauge is increased to 27/38 mm, and the drafting ratio is 7.0~8.0 to strengthen the control of the fibers in the drafting zone. In addition, under the same twist coefficient condition, the flame retardant roving structure is relatively loose, so the roving twist coefficient is controlled at 80-100, and the tension elongation is strictly controlled, and the elongation change range of a doff is required to be in the range of 1% to 2%. If the roving is wrapped around the top roller, use antistatic coating to treat the top roller.

(5) Spinning process: Selecting rubber rollers with a hardness of 65, in relative increase the pressure the pressure of the rubber roller, measures such as enlarging the apron jaws and increasing the draft ratio of the rear zone (appropriately 1.2 times) should be taken to reduce the drafting force and improve the quality of the yarn. Selecting 772 traveler compress the diameter of the air ring and reduce the rate of spun yarn breakage. In addition, the spun yarn twist coefficient can be slightly larger, generally 370~410 can be selected.

(6) Winding process: Due to the serious static electricity phenomenon, for ensuring good bobbin forming, the following condition is necessary including: appropriately reduce the speed of the grooved drum and reduce the tension, and remains smooth and free of burrs in the yarn channel, and reduce the deterioration of the sliver and the generation of hairiness. The setting of electrical cleaning parameters focuses on removing coarse details, impurities and nep of single yarn. Connector adopts an air splicer.

(7) The yarn is woven into flame retardant fabric, the yarn count is 8~32 s, namely 8 s, 10 s, 12 s, 14 s, 16 s, 20 s, 24 s, 26 s, 28 s, 32 s. Knitted fabrics are obtained after weaving. According to the application scenarios of flame retardant fabrics, such as mattresses, sofas, etc., different fabric weights can be selected. The fabric weights can be 180 g/m2, 220 g/m2, 260 g/m2, 300 g/m2, 330 g/m2, 370 g/m2, the above grain weight +−10%.

Compared with the prior art, the beneficial effects of the present invention are as follows:

1. The flame retardant fabric of the present invention is directly woven from flame retardant viscose fiber. The flame retardant fabric does not need to be flame retardant after finishing, and has a good flame retardant effect and saves costs through simply the production process.

2. The flame retardant viscose fiber of the application invention uses silicic acid as an inorganic flame retardant substance, and the surface of the silicic acid is coated with a layer of organic material, and then prepared into nano-scale particles. The flame retardant viscose fiber with the flame retardant particles has little effect on the strength of fiber. In addition, the filter device won't be clogged during spinning, because the silicic acid is coated with a layer of organic material, which can avoid the silicic acid gels with the zinc sulfate in the coagulation bath.

3. The flame retardant viscose fiber of the present invention is added with a silicic acid flame retardant coated with organic material, which improves the limiting oxygen index and flame retardant performance, the limiting oxygen index is as high as 32% or more, and the ash content is more than 30%. Besides, the presence of sub-nano-level flame retardant particles coated with melamine resin, the silicic acid flame retardant of the flame retardant fabric is not easy outflow and denature after the wash, and give the flame retardant fabric a long-lasting flame retardant effect.

4. The denier of the flame retardant viscose fiber of the present invention is 1.11~2.78 dtex, and the strength is ≥2.0N/dtex by adding flame retardant particles of nano-agents and through a suitable spinning process, which meets the production requirements of spinning.

Example 1

(1) Preparing of Spinning Dope

Soaking the pulp raw material in a sodium hydroxide solution with a temperature of 53° C. and a concentration of 17% to 18%. After 45 minutes, the Alkaline liquid will dissolve the low-polymerization degree of hemicellulose to obtain the undissolved part, which is α-cellulose. Press to obtain alkali cellulose with a diameter of 15 μm~20 μm. The alkali cellulose is crushed and aged. The aging temperature is 20° C., and the aging time is 2 h; then 30% CS2 of α-cellulose quantity is added and mixed for yellowing reaction. The yellowing temperature is 15° C., and the yellowing time is 30 minutes to generate cellulose xanthate; dissolve the cellulose xanthate in 5% sodium hydroxide solution to obtain a spinning solution, and then add α-cellulose 2% denaturant, the spinning solution continue the process in turn by dissolved, filtered, defoamed, and matured to obtain a spinning Stock solution that can be directly spun. The spinning Stock solution index: α-cellulose: 9.21 wt %, alkali content 5.3 wt %, esterification degree 65, viscosity 103 s.

More relevant information about this original source text is required to display other translation information (2) Preparing of Flame Retardant Dissolving $Na_2O{\cdot}nSiO_2$ (where n=1~1.5) in pure water at a temperature of 50~80° C. and stirring evenly for 30 minutes, then slowly add dilute sulfuric acid solution dropwise; adjusting the pH to 3~4 to obtain a silicic acid solution; and according to the quality of $Na_2O{\cdot}nSiO_2$, using 15% melamine, 1% carbonamide, 20% formaldehyde, then add 1.5% dispersant, adjusting the pH to 9 with triethanolamine at under 70~80° C. through high-speed shearing and stirring with stirring speed 7000~8000 r/min, to obtain the prepolymer mixture. The prepolymer mixture is put into the silicic acid solution by dripping under high-speed stirring and filtered to prepare a uniformly dispersed flame retardant slurry. The solid content is 42.6%, and the particle size is less than 1 micron.

(3) Injecting Flame Retardant Before Spinning

The temperature of the spinning solution is controlled at 20~25° C. by the heat exchanger, and 30-50 wt % of the effective ingredients of the flame retardant slurry for α-cellulose is injected into the spinning solution, then pass through the first pre-spinning injection system, afterwards, the spinning solution is uniformly mixed by the static mixer, and inject the denaturant ethanolamine and cyclohexylamine (quantity ratio 1:1) therein, then pass through the second pre-spinning injection system, so that form into a spinning stock solution, further, the spinning solution is continuation uniformly mixed by the dynamic and static mixer to obtain the spinning Stock solution that can be directly spun.

(4) In the spinning machine, the spinning Stock solution reacts with the coagulation bath while being extruded by the nozzle and to obtain the nascent fiber tow; the coagulation bath component sulfuric acid 95 g/L, zinc sulfate 25 g/L, sodium sulfate 250 g/L, reaction temperature: 40° C., and two bath temperature 90° C.

(5) Post-processing

The nascent fiber tow further process by 25-% nozzle drafting, 30% spinning disk drafting, 8% plasticizing bath drafting, and which use −1% re-tracting drafting to the aforesaid four drafting and plasticizing and shaping, then, cutting and post-treatment are carried out. The post-treatment processes include pickling, desulfurization, water washing, and oiling; and then drying to obtain flame retardant viscose fiber.

Desulfurization: sodium sulfite concentration 25 g/L, temperature 85° C.

Water washing: PH value 7.5, temperature 70~75° C.

Oil bath: pH 7-8, temperature 65° C., concentration 10 g/L.

The finished product index of flame retardant viscose fiber prepared by the above process: fineness 1.33 dtex, strength 2.4 CN/dtex.

Production Process of Flame Retardant Fabric (1) Blowing process: The air outlet of the dust cage adopts a full air supply method, the beater speed is 600 rpm; the blade extension height is 2.5 mm; the distance between the needle beater and the integrated beater is 12*20 mm; the distance between dust rods should be as small as 3 mm; the volume of rolls to 350 g/m.

(2) Carding process: the cylinder speed is 300~340 r/min; the licker roll speed is 600~750 r/min. Under the premise of avoiding the cylinder winding and card clothing stuffing, the distance between the cylinder and the cover is too small. Master 9*9*8*8*7 inches. The distance between the cylinder and the front cover can be appropriately enlarged to 30*38*38*30 British silk. The tension draft ratio should be small and controlled at 1 to 1.1 times. If the fiber strip is bulky, it is easy to block the bell mouth and the inclined tube of the coil, reduce the doffer speed (13~15 r/min), increase the pressure of the roller (16~18 kg), and reduce the diameter of the compressed horn (2.6~3.0 mm), sprinkle talcum powder in the ring channel, leave sliver when the empty sliver tube is on the car.

(3) Drawing process: The roller gauge should be appropriately enlarged to 15 mm×25 mm during pre-binning to keep the drafting stable. At the same time, it adopts the forward drafting process configuration, and the drafting ratio is controlled at about 7.0~8.0 times. In addition, because the cotton sliver is fluffy, the drawing length should be appropriately reduced to 1500~2000 meters to avoid the fiber layer being too high when the capacity is large. The relative humidity of the workshop should be controlled at 70-75%, and the top roller should be an anti-static top roller. Reduce the speed of the front roller; at the same time wipe the bell mouth and the inclined tube with alcohol, and sprinkle talcum powder; keep the channel smooth and smooth to reduce friction resistance; choose a smaller diameter of the bell mouth (2.6, 2.8); increase the pressure of the pressing roller (13.5-14.5 kg), etc. can basically avoid the blockage of the inclined tube of the coil, and ensure the smooth delivery of the strip.

(4) Roving process: The basis weight control at 3.0~4.5 g/10 m, and the speed reduction at 500-600 r/min, the roller gauge is increased to 27/38 mm, and the drafting ratio is 7.0~8.0 to strengthen the control of the fibers in the drafting zone, and help stabilize the relationship between the drafting force and the holding force, and prevent "hard ends". The roving twist coefficient is controlled at 80-100, and the tension elongation is strictly controlled, and the elongation change range of a doff is required to be in the range of 1% to 2%. If the roving is wrapped around the top roller, use antistatic coating to treat the top roller.

(5) Spinning process: Selecting rubber rollers with a hardness of 65, in relative increase the pressure the pressure of the rubber roller, measures such as enlarging the apron jaws and increasing the draft ratio of the rear zone (appropriately 1.2 times) should be taken to reduce the drafting force and improve the quality of the yarn. Selecting 772 traveler compress the diameter of the air ring and reduce the rate of spun yarn breakage. In addition, the spun yarn twist coefficient can be slightly larger, generally 370~410 can be selected.

(6) Winding process: Due to the serious static electricity phenomenon, for ensuring good bobbin forming, the following condition is necessary including: appropriately reduce the speed of the grooved drum and reduce the tension, and remains smooth and free of burrs in the yarn channel, and reduce the deterioration of the sliver and the generation of hairiness. The setting of electrical cleaning parameters focuses on removing coarse details, impurities and nep of single yarn. Connector adopts an air splicer.

(7) The yarn is woven into a flame retardant fabric, the yarn count range is 8-32, and the weight range is 150-370 g/m2.

The above flame retardant fabrics meet the flame retardant standards stipulated by 16 CFR1633. The oxygen limit index is 32%, and the combustion residue is 30%. According to the method in GB/T5455-2014, the damage length is 115 mm, the afterburning time is ≤5 s, and the smoldering time is ≤5 s.

Example 2-8

In Examples 2-8, the processes and parameters are the same, and the quantity numbers of sodium silicate, formaldehyde, carbonamide, and melamine are changed, and the performance parameters of the flame retardant viscose fiber obtained are shown in Table 1 as below.

TABLE 1

Properties of flame retardant viscose obtained from different proportions of flame retardant

| Example | Sodium silicate (Quantity numbers) | Melamine (Quantity numbers) | Carbonamide (Quantity numbers) | formaldehyde (Quantity numbers) | Strong (N/dtex) | Fineness (dtex) |
|---|---|---|---|---|---|---|
| 2 | 100 | 12 | 0.5 | 10 | 1.4 | 2.22 |
| 3 | 100 | 13 | 1.5 | 15 | 1.5 | 1.98 |
| 4 | 100 | 14 | 2.5 | 20 | 1.7 | 1.56 |
| 5 | 100 | 15 | 3.5 | 25 | 2.0 | 1.38 |
| 6 | 100 | 16 | 4.5 | 30 | 1.8 | 1.33 |
| 7 | 100 | 17 | 5.0 | 35 | 1.7 | 1.36 |
| 8 | 100 | 18 | 5.5 | 40 | 1.5 | 1.98 |

It can be seen from the above table that the fineness and strength of the flame retardant fibers obtained in Examples 5 and 6 are better. Weave the above yarns into flame retardant fabrics, the yarn count is 8~32 s, namely 8 s, 10 s, 12 s, 14 s, 16 s, 20 s, 24 s, 26 s, 28 s, 32 s. After weaving, the rib stitch fabric is obtained, and the weight of the fabric can be 150-370 g/m2. The above flame retardant fabrics meet the flame retardant standards stipulated by 16 CFR1633. The oxygen limit index is greater than 32, and the combustion residue is greater than 30%. According to the method in GB/T5455-2014, the damage length is ≤130 mm, the afterburning time is ≤5 s, and the smoldering time is ≤5 s.

Examples 9-15

To inject the flame retardant slurry obtained in Example 5 into the spinning solution. The processes and parameters are the same as those in Example 1. To inject the flame retardant slurry with different quantity ratios into the spinning solution to obtain a count of 32 s and 260 gsm of the flame retardant fabric is shown in Table 2 as below.

| Example | Flame retardant particle quantity (%) | Strong (cN/dtex) | Combustion residue (%) | LOT |
|---|---|---|---|---|
| 9 | 10 | 2.5 | 25 | 26 |
| 10 | 20 | 2.3 | 26 | 29 |
| 11 | 30 | 2.1 | 28 | 32 |
| 12 | 40 | 1.9 | 30 | 33 |
| 13 | 50 | 1.8 | 32 | 33 |
| 14 | 60 | 1.7 | 33 | 34 |
| 15 | 70 | 1.6 | 34 | 36 |

It can be drawn from the above table that as the content of flame retardant particles increases, the flame retardant performance improves, but the strength decreases. Taking into account comprehensively, the effect is better if the content is 40-50%.

The basic principles, main features and advantages of the present invention have been shown and described above. Those skilled in the industry should understand that the present invention is not limited by the foregoing embodiments. The foregoing embodiments and descriptions only illustrate the principles of the present invention. Without departing from the spirit and scope of the present invention, the present invention may have Various changes and improvements fall within the scope of the claimed invention.

What is claimed is:

1. A flame retardant viscose fiber, wherein an inorganic flame retardant component in the flame retardant viscose fiber is a silicic acid substance, the fineness of the flame retardant viscose fiber is 1.11~2.78 dtex, the dry strength of the flame retardant viscose fiber is greater than 2 cN/dtex, and the dry elongation of the flame retardant viscose fiber is 13~20%;

the silicic acid substance is coated with an organic material which is a melamine flame retardant resin;

the silicic acid substance is obtained by acidification of sodium silicate, the melamine flame retardant resin is prepared from melamine, carbonamide and formaldehyde, and the added quantity of the melamine is 15-20% of the sodium silicate, the added quantity of the carbonamide is 1~5% of the sodium silicate, and the added quantity of the formaldehyde is 20-40% of the sodium silicate.

2. The flame retardant viscose fiber as claim 1, wherein a limiting oxygen index value of the flame retardant viscose fiber is not less than 32%, and the combustion residue is not less than 30%.

3. The flame retardant viscose fiber as claim 1, wherein the effective component of the silicic acid substance is silica, the added quantity of silica is 30-50% of the flame retardant viscose fiber.

* * * * *